United States Patent [19]

Musumiya et al.

[11] Patent Number: 4,522,082

[45] Date of Patent: Jun. 11, 1985

[54] PEDAL ASSIST APPARATUS

[75] Inventors: Raita Musumiya, Kawagoe; Hideo Sano, Kuki; Yasuto Izichi, Kuki; Mitsuru Inoue, Kuki; Kenzyu Izawa, Tokyo, all of Japan

[73] Assignees: Honda Giken Kogyo Kabushiki Kaisha, Tokyo; Fukuda Press Kogyo Kabushiki Kaisha, Saitama, both of Japan

[21] Appl. No.: 491,384

[22] Filed: May 4, 1983

[30] Foreign Application Priority Data

| | | | |
|---|---|---|---|
| May 4, 1982 | [JP] | Japan | 57-637772 |
| May 4, 1982 | [JP] | Japan | 57-63773 |
| Jun. 23, 1982 | [JP] | Japan | 57-92995 |

[51] Int. Cl.[3] ..... G05G 1/14

[52] U.S. Cl. ..... 74/512; 74/470; 192/99 S

[58] Field of Search ..... 74/512, 518, 470; 192/99 S

[56] References Cited

U.S. PATENT DOCUMENTS

| | | | |
|---|---|---|---|
| 1,810,103 | 12/1928 | Flagstad | 74/512 X |
| 3,014,381 | 1/1960 | Frank | 74/512 |
| 3,199,366 | 12/1960 | Herrington | 74/512 |
| 3,199,367 | 8/1965 | Zetye | 74/512 |
| 3,878,926 | 4/1975 | Adachi | 74/470 X |
| 4,319,497 | 3/1982 | Shinto et al. | 74/512 |
| 4,353,430 | 10/1982 | Sjoqvist et al. | 74/512 X |

FOREIGN PATENT DOCUMENTS

| | | | |
|---|---|---|---|
| 1241857 | 8/1960 | France | 74/512 |
| 2380160 | 10/1978 | France | 74/518 |
| 51-35863 | 3/1976 | Japan . | |
| 526660 | 9/1940 | United Kingdom | 192/99 S |

*Primary Examiner*—Kenneth J. Dorner
*Assistant Examiner*—Rodney M. Lindsey
*Attorney, Agent, or Firm*—Armstrong, Nikaido, Marmelstein & Kubovcik

[57] ABSTRACT

An assist apparatus for a clutch pedal which includes a pedal arm supported on a machine frame through a supporting shaft so as to be turnable between its inoperative position on one side and its operative position on the other side. A first spring seat and a second spring seat facing the first spring seat are turnably supported on the pedal arm and the machine frame respectively, through a first seat shaft on the pedal arm and a second seat shaft on the machine frame. The seat shafts are parallel with the supporting shaft. A pair of springs are provided between the two spring seats so that the two seats are urged along a direction of a connecting line connecting between an axis of the first seat shaft and an axis of the second seat shaft. The pair of springs are disposed at symmetrical positions on both sides of the connecting line. Each of the seats is provided with inwardly projecting opposite side walls and is turnably mounted and supported on each of the seat shafts which provide side walls thereof.

4 Claims, 19 Drawing Figures

PEDAL ASSIST APPARATUS

BACKGROUND OF THE INVENTION

This invention relates to an assist apparatus for a pedal such as a clutch pedal for a motorcar or the like.

Various apparatuses of this kind have been known such as the type shown in FIGS. 1 and 2. In such a Prior Art apparatus, a pedal arm b is supported through a supporting shaft e on a machine frame a so as to be turnable between its inoperative position on one side and its operative position on the other side. A first spring seat c and a second spring seat d facing the first spring seat c are turnably connected on a crank arm extension of the pedal arm b and the machine frame a, respectively. That is, the first spring seat c is supported by a first seat shaft f on the crank arm extension of the pedal arm b and the second spring seat d is supported by a second seat shaft g on the machine frame a. The seat shafts f, g, are parallel with the supporting shaft e. A spring means i comprising a compression coil spring mounted on a guide rod h is provided between the two seats c, d so that the two seats c, d may be urged thereby along a direction of a connecting line connecting between the axis of the first seat shaft f and the axis of the second seat shaft g. In this manner, when the pedal arm b is turned, the first seat shaft f is turned to move to one side or the other side across a line connecting between the axis of the supporting shaft e and the axis of the second shaft g. A torque represented by product of a resilient force of the spring means i and an offset length $l_1$ of the line of action of the spring means i from the supporting shaft e is applied to the pedal arm b. (Japanese Utility Model Publication SHO No. 51-35863). In this type of apparatus, if the distance $l_2$ between the seat shafts f, g is decreased, a swing angle of the line of action of the spring i can be increased to obtain a larger torque. Additionally, the second spring seat d can be supported on the second seat shaft g provided on the machine frame a which is located near the first seat f, through an L-shaped bracket j extending sideways and inwards from an outer end portion of the rod h attached to the seat d. This arrangement, however, has the disadvantage that because a supporting portion for bearing the second seat shaft g is applied with a bending moment corresponding to an axial or longitudinal distance $l_3$ thereof from the second spring seat d, in addition to being applied with a radial load caused by the resilient force of the spring means i, a smooth turning of the seat d about the shaft g cannot be obtained. Additionally, because the first seat shaft f is positioned at an outer end of the first spring seat c, the distance from the shaft f to the outer end of the rod h becomes large.

OBJECTS AND SUMMARY OF THE INVENTION

It is an object of the present invention to provide a pedal assist apparatus in which no bending moment is applied to structure of the apparatus. In other words, all of the loads are radial or longitudinal.

Further, it is an object of the present invention to provide a compact pedal assist apparatus.

It is yet another object of the present invention to provide the pedal assist apparatus which is simple to construct.

It is still another object of the present invention to provide a pedal assist apparatus in which it is possible to increase the assist torque without greatly increasing the size of the apparatus.

These and other objects are obtained in an assist apparatus for a pedal wherein the general structure includes a pedal arm supported on a machine frame through a supporting shaft so as to be turnable between its inoperative position on one side and its operative position on the other side. A first spring seat and a second spring seat facing the first spring seat are turnably supported on the pedal arm and the machine frame respectively, through a first seat shaft on the pedal arm and a second seat shaft on the machine frame. The seat shafts are parallel with the supporting shaft. A spring means is provided between the two spring seats so that the two seats are urged along a direction of a connecting line connecting between an axis of the first seat shaft and an axis of the second seat shaft. Each of the seats is provided with inwardly projecting opposite sidewalls and is turnably mounted and supported on each of the seat shafts at opposite sidewalls thereof. The spring means comprises a pair of springs disposed at symmetrical positions on both sides of the connecting line.

A pair of guide rods can be disposed at symmetrical positions on both sides of the connecting line. The guide rods are provided between the two seats. Each of the springs comprises a compression coil spring mounted on one of the guide rods.

An alternative embodiment, is provided wherein the inwardly projecting opposite sidewalls of each of the spring seats are provided at their portions which are near the base ends thereof, with guide openings extending longitudinally along the connecting line. The first spring seat is mounted and supported slideably on the second seat shaft at its guide openings. The second spring seat is mounted and supported slideably on the first seat shaft at its guide openings. Each of the springs comprises a tension spring applied between the two seats.

In addition, the machine frame can be provided with a stopper at the final period of a return turning of the pedal arm to its inoperative position which is brought into abuttment with either one of the two seats for restraining the same from further turning.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF PREFERRED EMBODIMENTS

Figure 1:
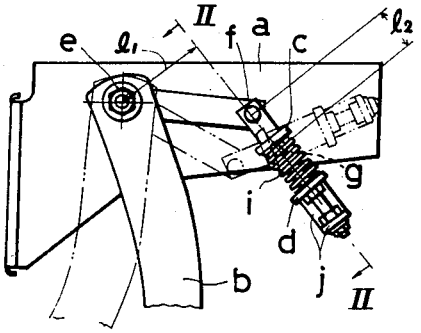
FIG. 1 PRIOR ART
FIG. 1 is a side view of a conventional apparatus.
Figure 2:
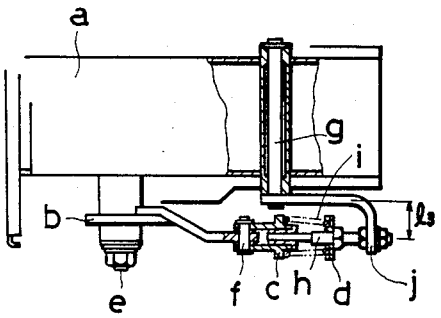
FIG. 2 PRIOR ART
FIG. 2 is a sectional view taken along the Line II—II in FIG. 1.
Figure 3:
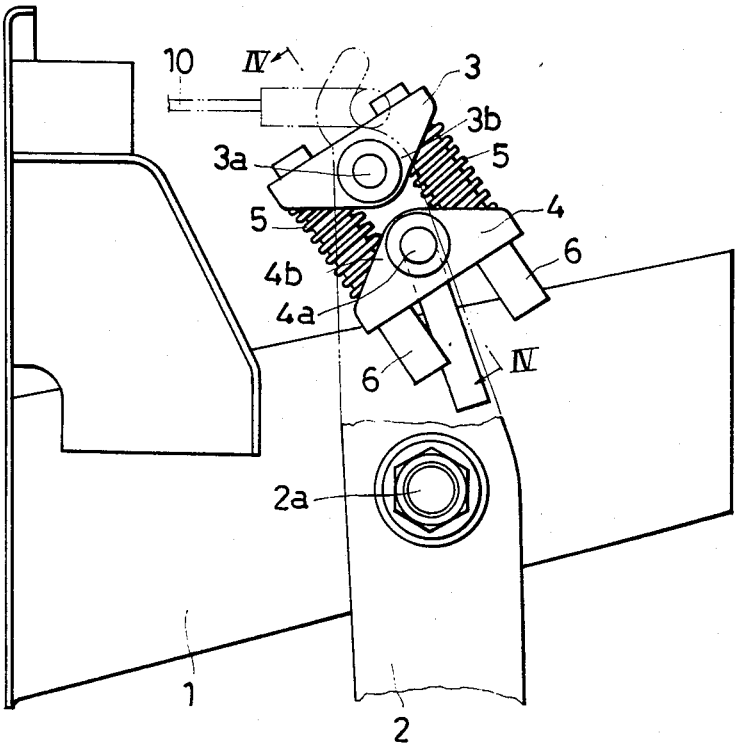
FIG. 3 is a side view of a first embodiment of this invention.
Figure 4:
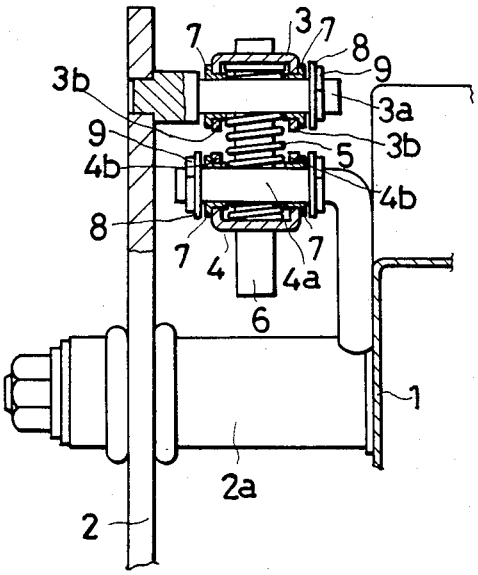
FIG. 4 is a sectional view taken along the Line IV—IV in FIG. 3.
Figure 5A:
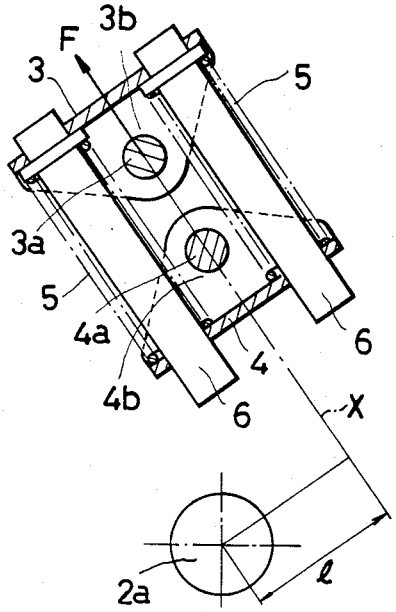
FIGS. 5*a*, 5*b* and 5*c* are side views explaining the essential portion of the present invention.
Figure 5B:
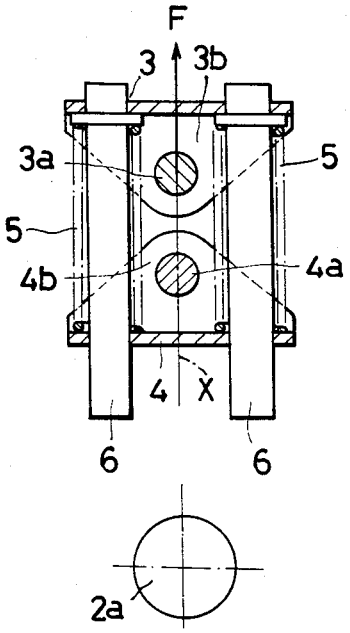
Figure 5C:
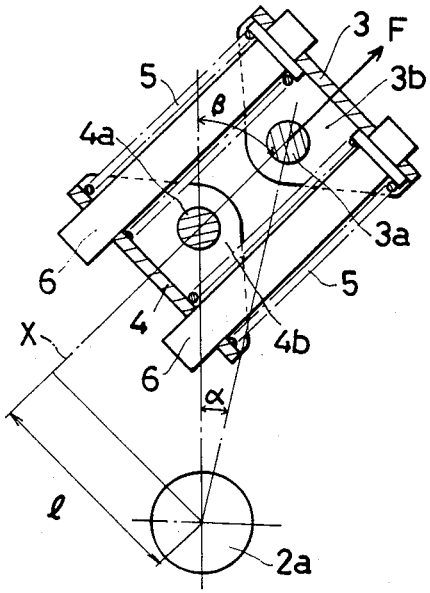
Figure 6:
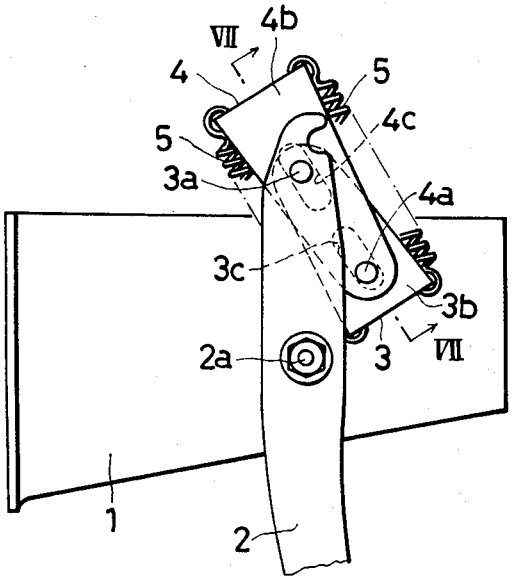
FIG. 6 is a side view of a second embodiment.
Figure 7:
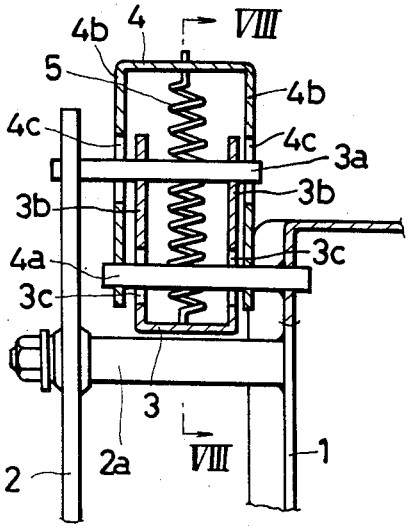
FIG. 7 is a sectional view taken along the line VII—VII in FIG. 6.
Figure 8:
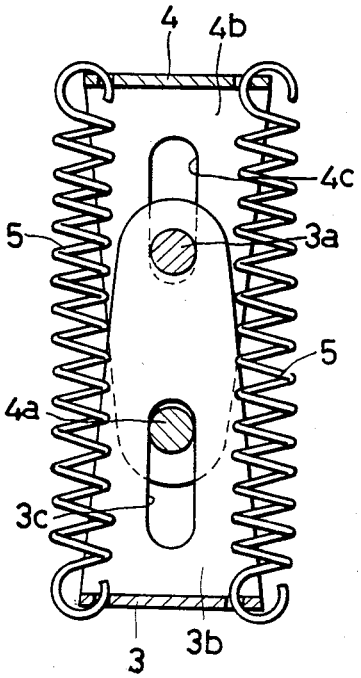
FIG. 8 is an enlarged sectional view taken along the line VIII—VIII in Figure in FIG. 7.

Embodying examples of this invention will now be explained with reference to the accompanying drawings:

Referring to FIGS. 3 to 5 showing a first embodiment, a machine frame 1 attached to a motorcar body or the like supports a pedal arm 2 through a supporting shaft 2*a* so that it is turnable between its inoperative position on one side and its operative position on the other side. A first seat shaft 3*a* which is parallel with the supporting shaft 2*a* is fixedly provided on the arm 2. A first spring seat 3 is turnably supported on the shaft 3*a*. A second seat shaft 4*a* which is parallel with the supporting shaft 2*a* is fixedly provided on the machine frame 1. A second spring seat 4 facing the first spring seat 3 is turnably supported on the shaft 4*a*. A spring means 5 is provided between the two seats 3, 4 so that the two seats 3, 4 may be urged thereby along a direction of a connecting line X connecting between the axis of the first seat shaft 3*a* and the axis of the second seat shaft 4*a*.

According to this invention, each of the seats 3, 4 is provided with inwardly projecting opposite side walls 3*b*, 3*b*, 4*b*, 4*b*, formed by inwardly bending of both end portions thereof, and is turnably mounted and supported on each of the seat shafts 3*a*, 4*a* at its opposite side walls 3*b*, 3*b*, 4*b*, 4*b*. The spring means 5 is composed of a pair of springs 5, 5 disposed at symmetrical positions on both sides of the connecting line X.

In the illustrated example, each of the springs 5, 5 is a compression coil spring. A pair of guide rods 6, 6, disposed at symmetrical positions on both sides of the connecting line X are provided between the two seats 3, 4 as to be loosely inserted through the mutually facing seats 3, 4. Each spring 5 is mounted on each guide rod 6 so that is expansion and construction movements may be guided therealong. Additionally, the opposite side walls 3*b*, 3*b*, 4*b*, 4*b* of each of the seats 3, 4 are provided with respective oil-less bushes 7, 7, mounted thereon, and each of the seat shafts 3*a*, 4*a* is inserted therethrough.

Referring to the drawings, a washer 8 and a split pin 9 are applied to each of the seat shafts 3*a*, 4*a*. An operation wire 10 in engagement with the pedal arm 2 and is connected to a load such as a clutch or the like.

Next, the operation of the foregoing first embodiment is explained as follows:

When the pedal arm 2 is located at the inoperative position shown in FIG. 3, the supporting shaft 2*a* of the arm 2 and the seat shafts 3*a*, 4*a* of the two spring seats 3, 4 are in the relationship as shown in FIG. 5*a*. The composition force F of the resilient forces of the springs 5, 5, acts along on the connecting line X connecting between the two seat shafts 3*a*, 4*a*. Consequently, a return torque in the counterclockwise direction in the drawings which can be expressed by the product of the composition force F and an offset length l of the line of action X of the composition force F from the supporting shaft 2*a* acts about the supporting shaft 2*a* of the pedal arm 2 through the first seat shaft 3*a*.

If, thereafter, the pedal arm 2 is turned from the inoperative position in the clockwise direction, the first seat shaft 3*a* is moved along the rotation locus about the supporting shaft 2*a*, and thereafter, if the first seat shaft 3*a* goes across a dead point which is positioned in alignment with a line connecting between the axis of the supporting shaft 2*a* and the axis of the second seat shaft 4*a* as shown in FIG. 5*b*, then the offset direction of the line of action X of the composition force F in relation to the supporting shaft 2*a* becomes the reverse of the foregoing one. As a result, the arm 2 is applied with an assist torque in the clockwise direction.

Figure 13:
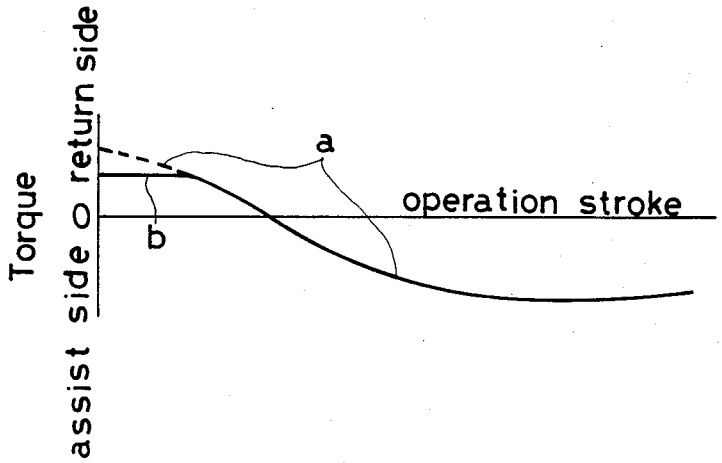
FIG. 13 is a diagram showing change characteristics of the torque applied to a pedal arm.
Figure 14:
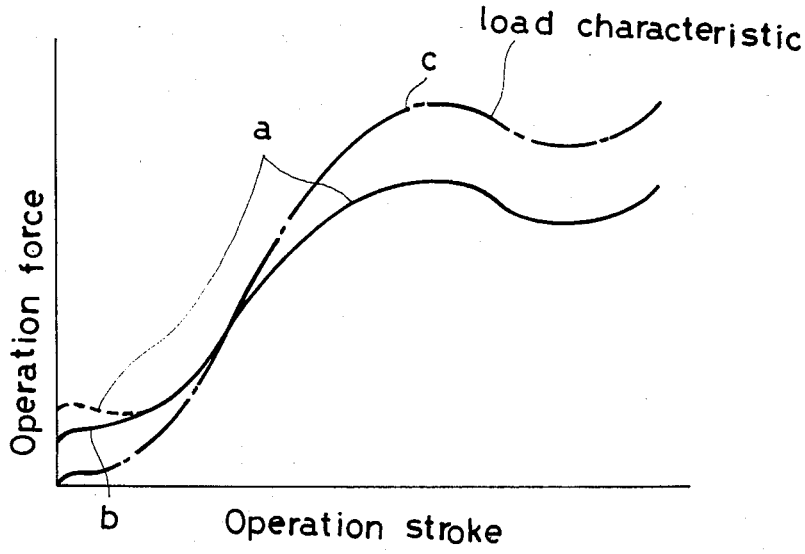
FIG. 14 is a diagram showing change characteristics of the operation force.

The change of the torque in relation to the operation stroke of the pedal arm 2 from the inoperative position thereof is as shown by a curve a in FIG. 13. The change of the operation force during this operation stroke is as shown by a curve a in FIG. 14, owing to its relation with load characteristics of the arm 2 shown by curve c in FIG. 14.

The foregoing operation is not especially different from that in the foregoing conventional apparatus. However, according to this invention, because the two seats 3, 4 are mounted and supported on the respective seat shafts 3*a*, *l* 4*a* at their respective inwardly projecting opposite side walls 3*b*, 3*b*, 4*b*, 4*b*, the distance between the two seat shafts 3*a*, 4*a* is decreased, and a swing angle $\beta$ of the foregoing line of action X in relation to a moving angle $\alpha$ of the first seat shaft 3*a* becomes large. Thus, it is possible to increase the assist torque by an increase of the offset length l. Additionally, the supporting portions for bearing the respective seat shafts 3*a*, 4*a* of the opposite side walls 3*b*, 3*b*, 4*b*, 4*b* of the respective seats 3, 4 are only subject to the resilient forces of the springs 5, 5 acting thereon as radial loads. No bending moment is applied thereto, so that each of the seats 3, 4 can be turned smoothly in accordance with turning of the pedal arm 2. Consequently, no obstruction of the assist effect occurs.

When a compression coil spring is used as the spring 5 as mentioned in the foregoing first embodiment, it is inevitable that the guide rods 6 are provided serving as spring guides. As a result, the number of parts is increased.

In a second embodying example shown in FIGS. 6 to 9, the spring 5 is a tension spring and thus the guide rod 6 may be omitted.

To explain the same more in detail, the inwardly projecting opposite side walls 3*b*, 3*b*, 4*b*, 4*b* of the respective seats 3, 4 are provided at their respective rearward portions which are near the base ends thereof with guide openings 3*c*, 3*c*; 4*c*, 4*c* extending long along the direction of the connecting line X connecting between the two seat shafts 3*a*, 4*a*. The first spring seat 3 is mounted and supported slideably at the guide openings 3*c*, 3*c*, of the opposite side walls 3*b*, 3*b* thereof on the second seat shaft 4*a* and is mounted and supported turnably at the forward portions of the opposite side walls 3*b*, 3*b* thereof on the first seat shaft 3*a*. The second spring seat 4 is mounted and supported slideably at the guide openings 4*c*, 4*c* of the opposite side walls 4*b*—4*b* thereof on the first seat shaft 3*a* and is mounted and supported turnably at the forward portions of the walls 4*b*, 4*b* on the second seat shaft 4*a*. A pair of springs 5, 5 comprising a pair of tension springs disposed at symmetrical positions on both sides of the connecting line X are bridged in tension condition between the two seats 3, 4.

Figure 9A:
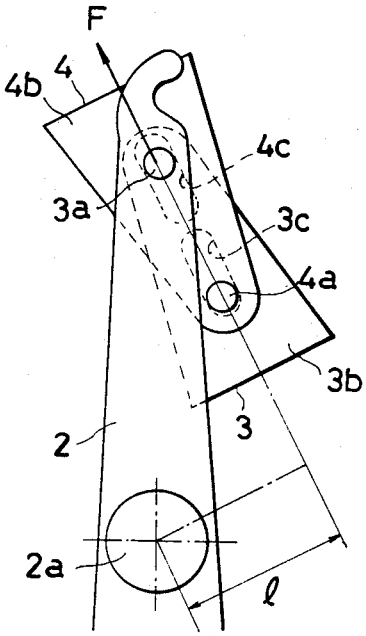
FIGS. 9*a*, 9*b* and 9*c* are side views for explaining the operation of an essential portion of the second embodiment.
Figure 9B:
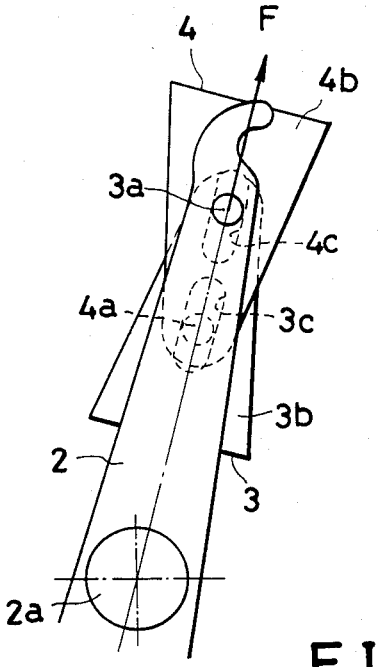
Figure 9C:
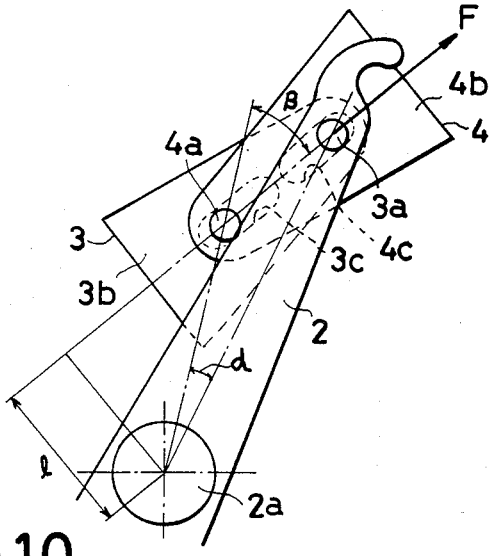

In this example, the respective seats 3, 4 are guided in their movements by the respective guide openings 3*c*, 3*c*; 4*c*, 4*c*, and a composition force F of the tension forces of the springs 5, 5 acts along on the connecting line X. Torque caused by the composition force F acts on the pedal arm 2 through the first seat shaft 3*a*, and almost the same operation as in the foregoing first embodying example can be obtained as shown in FIG. 9.

In the foregoing two embodiments, the return torque has the tendency, as shown by the curve a in FIG. 13, to be gradually increased as the pedal arm 2 comes nearer to the inoperative position. As a result thereof, at the time of turning operation of the pedal arm 2 from the inoperative position thereof, the operation force is once lowered at the initial period thereof as shown by the curve a in the FIG. 14, under the influence of the relation thereof with the load characteristics of the pedal arm 2, so that the feeling of the operation of the pedal is not normal.

Figure 10:
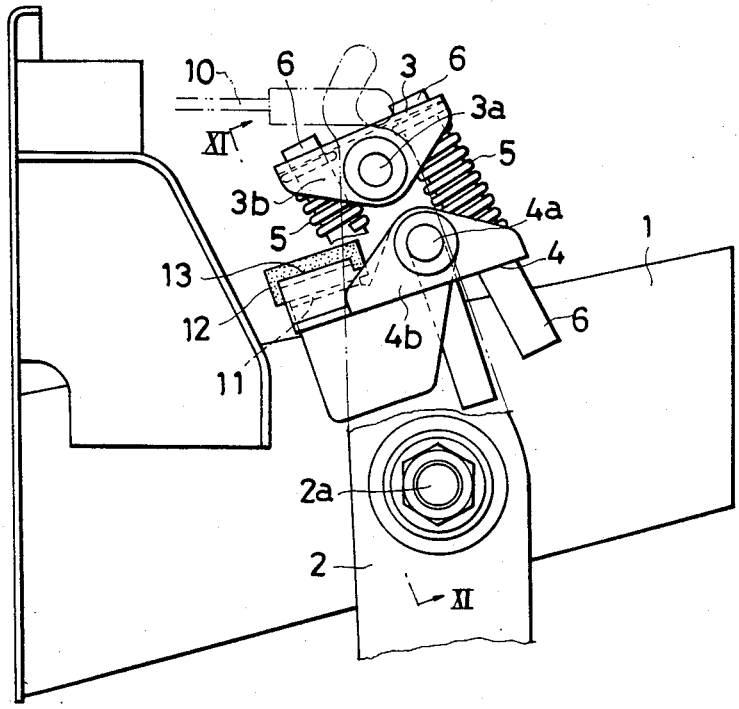
FIG. 10 is a side view of a third embodiment.
Figure 11:
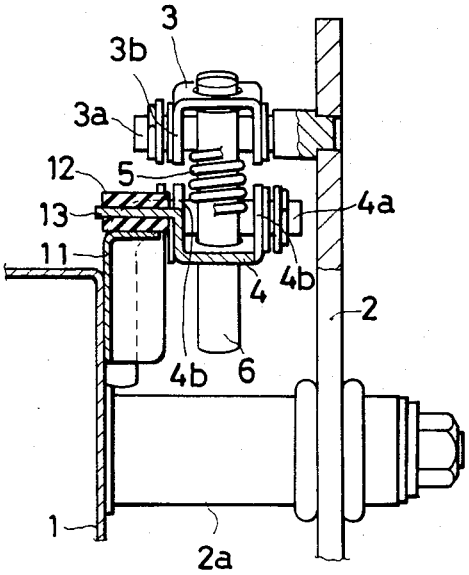
FIG. 11 is a sectional view taken along the line XI—XI in FIG. 10.
Figure 12A:
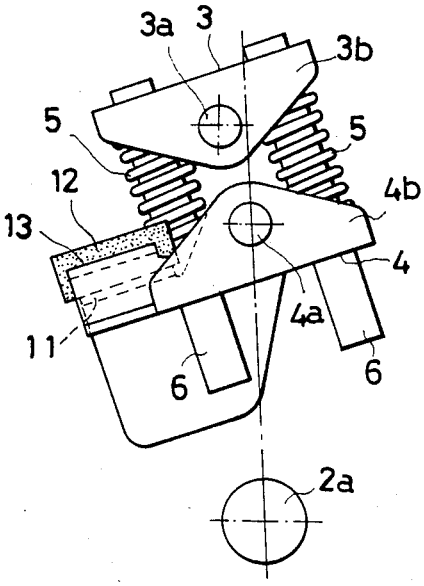
FIGS. 12*a* and 12*b* are side views for explaining the operation of an essential portion of the third embodiment.
Figure 12B:
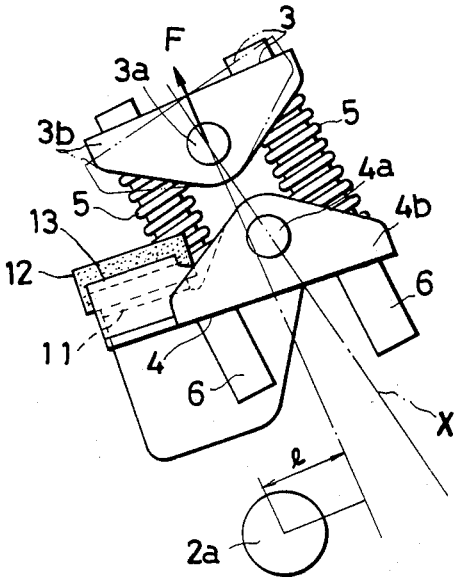

A third embodiment shown in FIGS. 10–12 is one free from this unfavorable feeling. Namely, this example is so constructed that the machine frame 1 of the foregoing first embodiment, for instance, is provided with a stopper 11 which, at the final period of the return turning of the pedal arm 2, is brought into abutment with either one of the two seats 3, 4 so as to restrain the pedal arm 2 from further turning. In the illustrated example, the second spring seat 4 is so arranged as to be brought into abutment with the stopper 11 at a projecting member 13 covered with a rubber cover 12 and projecting from one side end portion thereof. With this arrangement, at the final period of the return turning of the pedal arm 2 to its inoperative position, the second spring seat 4 is brought into abutment with the stopper 11 as shown in FIG. 12*a*, so that a further turning of the seat 4 about the second seat shaft 4*a* and also about the supporting shaft 2*a* is restrained, while the first spring seat 3 which has been kept in its posture crossing at right angles to the connecting line X between the two seat shafts 3*a*, 4*a* is caused to be further turned by a further return turning of the arm 2. Thus, the first spring seat 3 is changed from the foregoing posture condition shown by dotted lines in FIG. 12*b* to a clockwise inclined condition shown by solid lines owing to the balance between the two springs 5, 5. In this manner, the line of action of the composition force F of the two springs 5, 5 is deflected clockwise in relation to the connecting line X, so that any increase in the offset length l of the line of action of the arm 2 from the supporting shaft 2 is prevented. Thus, the return torque becomes nearly constant as shown by a curve b in FIG. 13 at the final period of the return turning of the arm 2. Consequently, the changing characteristics a of the operation force of the arm 2 in relation to the operation stroke becomes as shown by a curve b in FIG. 14. A lowering of the operation force at the initial stage of the operation stroke from the inoperative position does not occur.

Though the second spring seat 4 has been so arranged as to be brought into abutment with the stopper 11 in the foregoing illustrated example, almost the same improved operation can be obtained also by such as arrangement that the first spring seat 3 is to be brought into abutment therewith.

Thus, according to this invention, the two spring seats 3, 4 are mounted and supported on the respective seat shafts 3*a*, 4*a* at their respective inwardly projecting opposite side walls 3*b*, 3*b*, 4*b*, 4*b*, so that the distance between the two seat shafts 3*a*, 4*a* is decreased. The torque applied to the pedal arm 2 can be increased. Additionally, no bending moment is applied to the shaft supporting portions for bearing the respective seats 3, 4, so that a smooth turning of each of those seats 3, 4 can be carried out. Furthermore, the apparatus can be constructed in a substantially square and compact form, which is advantageous in requiring a smaller attaching space in comparison with such a long-sized one as the convention apparatus.

It is readily apparent that the above-described pedal-assist apparatus meets all of the objects mentioned above and also has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. An assist apparatus for a pedal including a pedal arm supported on a machine frame through a supporting shaft so as to be turnable between its inoperative position on one side and its operative position on the other side, a first spring seat and a second spring seat facing the first spring seat turnably supported on the pedal arm and the machine frame, respectively, through a first seat shaft on the pedal arm and a second seat shaft on the machine frame which are parallel with the supporting shaft, and a spring means provided between the two spring seats so that the two seats thereby are urged along a direction of a connecting line connecting between an axis of the first seat shaft and an axis of the second seat shaft, characterized in that each of the seats is provided with inwardly projecting opposite side walls, and is turnably mounted and supported on each of the seat shafts at the opposite side walls thereof, and the spring means comprises a pair of springs disposed at symmetrical positions on both sides of the connecting line.

2. An apparatus of claim 1 further comprising a pair of guide rods disposed at symmetrical positions on both sides of the connecting line provided between the two seats, and wherein each of the springs comprises a compression coil spring mounted on each guide rod.

3. An apparatus of claim 1 characterized in that the inwardly projecting opposite side walls of each of the spring seats are provided at their portions which are near the base ends thereof with guide openings extending longitudinally along the connecting line, and the first spring seat is mounted and supported slidably on the second seat shaft at its guide openings and the second spring seat is mounted and supported slidably on the first seat shaft at its guide openings, and each of the springs comprises a tension spring applied between the two seats.

4. An apparatus of claim 1 characterized in that the machine frame is provided with a stopper which, at the final period of a return turning of the pedal arm to its inoperative position, is brought into abutment with either one of the two seats for restraining the same from turning.

* * * * *

UNITED STATES PATENT AND TRADEMARK OFFICE

CERTIFICATE OF CORRECTION

PATENT NO. : 4,522,082

DATED : June 11, 1985

INVENTOR(S) : Raita Musumiya et al

It is certified that error appears in the above-identified patent and that said Letters Patent is hereby corrected as shown below:

On face of patent, first prior foreign application serial number; Change "57-637772" to --57-63772--.

Signed and Sealed this

Third Day of December 1985

[SEAL]

Attest:

DONALD J. QUIGG

Attesting Officer

Commissioner of Patents and Trademarks